US006368255B1

(12) United States Patent
Chan-Rouse

(10) Patent No.: US 6,368,255 B1
(45) Date of Patent: Apr. 9, 2002

(54) DEVICE FOR STRETCHING AND YOGA

(76) Inventor: Perdita Chan-Rouse, 1515 Santa Barbara St., Santa Barbara, CA (US) 93101

( * ) Notice: Subject to any disclaimer, the term of this patent is extended or adjusted under 35 U.S.C. 154(b) by 0 days.

(21) Appl. No.: 09/689,016

(22) Filed: Oct. 11, 2000

(51) Int. Cl.[7] ..... A63B 21/00

(52) U.S. Cl. ..... 482/91; 482/907; 482/148; 482/126

(58) Field of Search ..... 482/91, 907, 148, 482/904, 131, 139, 136, 23, 24, 38–43

(56) References Cited

U.S. PATENT DOCUMENTS 3,119,614 A * 1/1964 Berry ..... 482/91
5,069,449 A * 12/1991 Wardwell ..... 482/91
5,209,712 A * 5/1993 Ferri ..... 482/91
5,624,359 A * 4/1997 Dean ..... 482/91

* cited by examiner

*Primary Examiner*—Jerome Donnelly
(74) *Attorney, Agent, or Firm*—Michael G. Petit

(57) ABSTRACT

An inexpensive, compact and portable device useful for assisting a person to stretch his/her muscles. The device consists of a flexible, inelastic strap having a plurality of large loops disposed along the length of the strap and attached thereto. The loops, preferably of 1–2 inch hemp webbing, are dimensioned to fit over large portions of the body extremities during stretching such as the thigh and/or shoulder. The large size of the loops enables the user to stretch various muscles or groups of muscles without the need for grasping the device. By obviating the need for grasping the device during a stretch, a user can maintain a completely relaxed position during a stretch, employing gravity to provide a stretching force. An advantage of stretching while relaxed is that the user may effortlessly hold the stretch longer, thereby enhancing the benefit of the stretch.

1 Claim, 2 Drawing Sheets

DEVICE FOR STRETCHING AND YOGA

BACKGROUND OF THE INVENTION

1. Field of the Invention

The present invention relates generally to exercise equipment and more particularly to a device for assisting a person to stretch tissues in portions of the body.

2. Prior Art

It is well known that stretching muscles prior to engaging in exercise reduces the probability for injuring muscles during vigorous exercise thereof. Stretching also serves to maintain the elasticity of muscle-associated tissue such as tendons. Stretching aids are known in the art that are designed to improve the quality of stretching. Such devices are described, for example, in U.S. Pat. Nos. 5,624,359 and 5,518,486. In operation, the prior art devices require that a portion of the device be grasped and held during the performance of a stretch. The force required to grasp the device limits both the time that the stretch may be sustained and prevents the user from relaxing during the stretch. The requirement for a user to grasp the device in order to effect operability in a stretching application is a serious limitation of the prior art devices. The grasping requirement limits the time that a person can comfortably sustain a stretch and thereby limits the effectiveness of the stretch. There remains a need for an inexpensive, portable device operable for assisting a person to stretch while relaxing wherein the device may be used to stretch a muscle or a muscle group without requiring the user to grasp the device or otherwise exert energy to contract muscles during the performance of a stretch.

SUMMARY

It is a first object of the invention to provide a device operable for enabling a person to stretch selected muscles by assuming a relaxed stable position and without substantial expenditure of energy.

It is a further object of the invention to provide a device operable for enabling a person to stretch selected muscles while in a relaxed position and wherein the device is portable and inexpensive.

It is yet a further object of the invention to provide a device operable for enabling a person to stretch selected muscles while in a sitting, lying or standing position.

It is still another object of the invention to provide a device meeting the above objectives that is made from a natural (non-synthetic) fiber such as hemp.

The above objectives are met by a flexible strap having a loop at each end and a plurality of loops spaced from one another therebetween. A suitable material for making the device is hemp webbing having a width of 1–2 inches. The strap is from 5–11 feet long and most preferably about 9 feet in length. The loops affixed to the strap have a diameter of about 10 inches and are spaced 5–15 inches from one another along the length of the strap. The loops may be spaced uniformly from one another along the length of the strap or the distance between loops may vary. The large loop diameter enables the user to insert an entire limb therewithin. In operation, appropriate loops are selected and positioned by the user to encircle those limbs participating in a stretch. After positioning the loops to engage the limbs, the user relaxes. The force of gravity on at least one of the engaged limbs exerts tension on the portion of the strap connecting the loops. Further relaxation of the body stretches one or more muscle groups.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
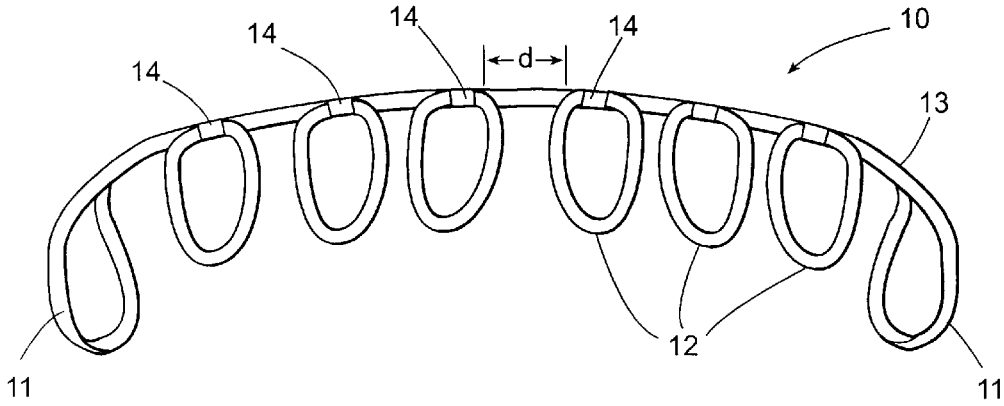
FIG. 1 shows a perspective view of a stretching device in accordance with the present invention.

FIG. 1 illustrates, in perspective view, an embodiment of the stretching device 10, operable for assisting a person to stretch and strengthen muscles in accordance with the present invention. The device 10 comprises a plurality of limb engagement means 12 operable for engaging a limb. The limb engagement means 12 are connected to one another by a flexible strap 13. Typically, the strap 13 is 3 to 4 feet long, although it may be shorter or as long as 8 feet as deemed suitable.

The limb engaging means 12 are sized such that each engaging means could hold part or entire human limb, such as a foot, thighs, arm or shoulders. In a preferred embodiment of the invention, the engaging means are loops, preferably of equal size. In general, the size of the loops is fixed; being selected to receive and accommodate the particular limb(s) associated with the performance of specific exercises or assumption of specific yoga positions. The distance d (FIG. 1) between each engaging means 12 is 6–12 inches but may vary with the length of the device 10.

The material comprising the strap 13 and loops 12 may be any flexible, durable inelastic web material, such as natural fibers, or any manmade material. In the preferred embodiment, the material comprising the strap and loops is between ¾ and 1 inch hemp webbing. A wider webbing may be used if extreme force will be used during exercise.

The plurality of limb engaging means 12 may be formed from 6 to 10 short strips of strap material. The loops 11 at opposing ends of the strap 13 are conveniently made by folding the end of the strap back over the strap and stitching the respective ends to the strap to form terminal loops on both ends of the strap. The short strips of strap material, which are substantially rectangular, may be folded over such that both ends of the strip(s) are adjacent to one another. At certain chosen points along the strap 13, spaced a distance d from one another, the two opposing adjacent ends of the strip(s) are permanently attached to the strap 13 by stitching, bar tacking or other suitable attachment means for bonding the strip ends thereto.

Figure 2:
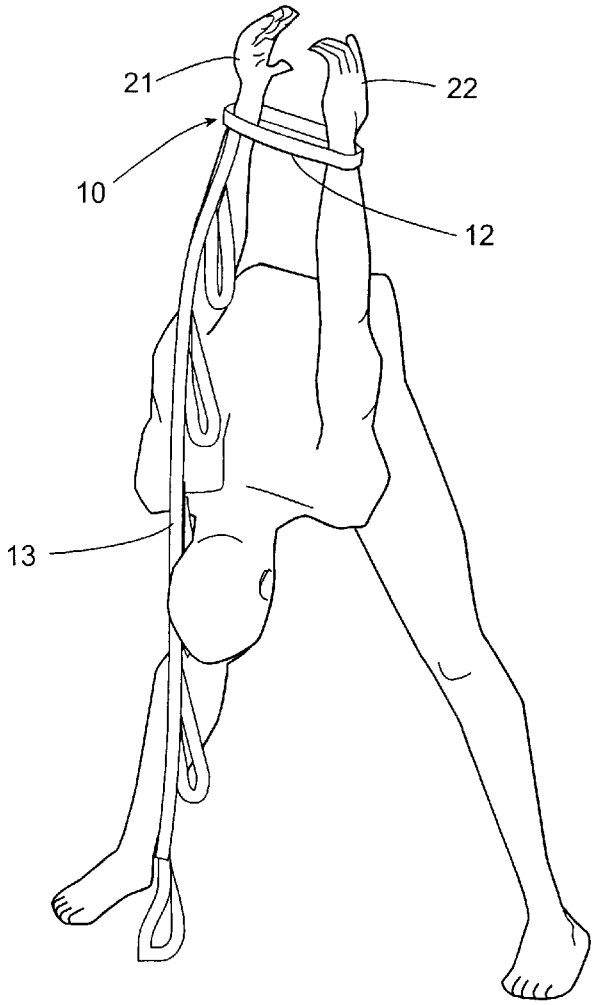
FIG. 2 is a perspective view illustrating a person using the device illustrated in FIG. 1 to stretch muscles in the upper arms and shoulders by placing the wrists into a single loop then stretching the shoulders.

The device 10 may be used to stretch tissue in a variety of ways. With reference now to FIG. 2, in one stretching exercise, designed to stretch the tissues of the shoulders and upper arms, one of the plurality of limb engaging means 12 of the device 10 is used to engage a portion of two limbs 21 and 22 of a person 20. The person 20 inserts limbs 21 and 22 into a single loop 12. Without grasping the loop 12 or strap 13, the person 20 leans forward and pushes the limbs 21 and 22 in opposite directions. At the same time, the user move limbs 21 and 22 toward the head in order to enhance stretching of muscles in the engaged limbs.

Figure 3:
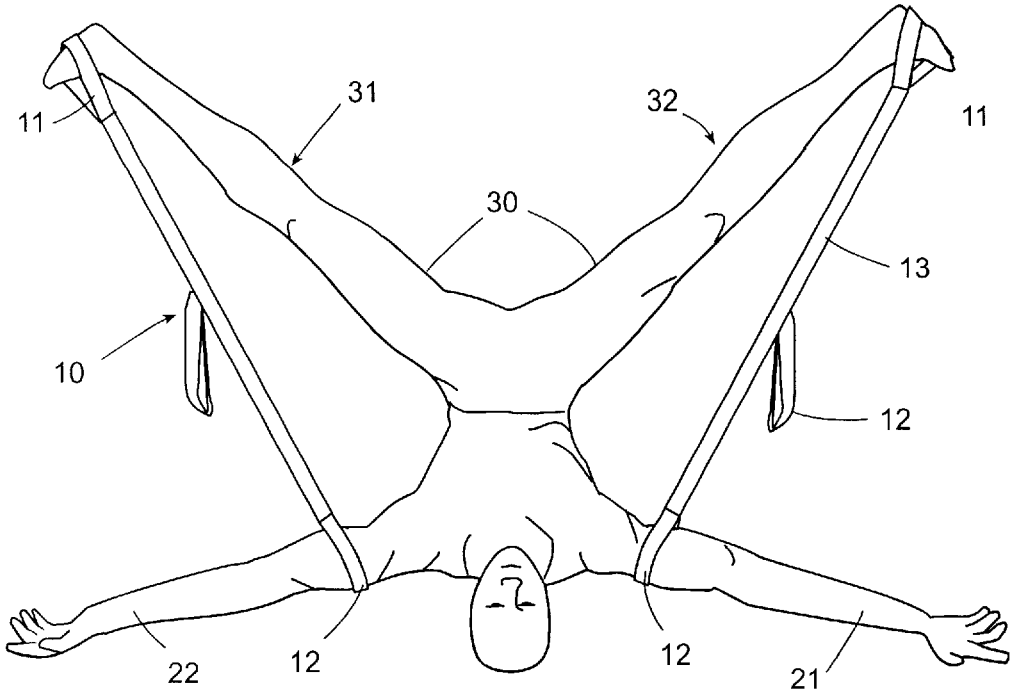
FIG. 3 is a perspective view illustrating use of the stretching device shown in FIG. 1 wherein the user has placed the arms and feet through loops and relaxed; thereby stretching muscles in the legs and hips.

Alternatively, as shown in FIG. 3, in order to stretch muscles 30 in the legs, such a stretch is facilitated by inserting limbs 31 and 32 into limb engaging means 11 of the device 10. Again, the force applied to the limb engaging means 11 during relaxation of the users body enhances stretching of muscles 30 in the engaged limbs by creating resistance that increases the benefits of stretching. This allows the limb to achieve a greater degree of flexion or extension than would have been possible without the added force applied via the device of the present invention.

Figure 4:
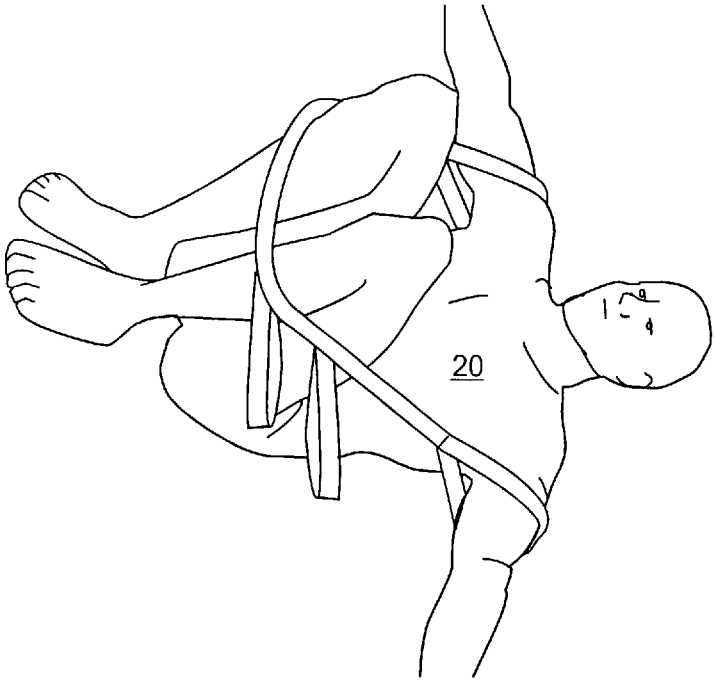
FIG. 4 is a perspective view illustrating a person using the device illustrated in FIG. 1 to stretch muscles in the buttocks and lower back by placing the strap around flexed legs and placing the arms through loops and relaxing, the weight of the arms providing the stretching force.

The versatility of the device 10 for assisting a person to stretch various muscle groups is further illustrated in FIG. 4. FIG. 4 is a perspective view illustrating a person using the device 10 to stretch muscles in the buttocks and hips by placing the strap around flexed legs and placing the arms through loops and relaxing, the weight of the arms and upper body providing the stretching force. In order to apply the force to the strap necessary to optimize the stretch, it is necessary to relax. Unlike prior art devices that require a user to grasp the device throughout the performance of a stretch, the present invention enables the user to optimize the stretch by relaxing. Thus, the present invention enables the user to stretch gradually as the user relaxes, and to sustain a stretch for a longer period of time once attained.

In summary, a stretching device 10 has been described. The device 10 has integral construction and is operable for assisting a person to stretch a targeted tissue in the person's body by assuming a relaxed position. The device essentially includes a flexible strap 13 having limb engaging means 11 comprising a terminal loop affixed to opposing ends thereof. The strap 13 connecting the terminal loops 11, which may be referred to in the alternative as a "strap body portion ", has a plurality of limb engaging means 12 such as, for example, a plurality of loops affixed to the strap body portion at points of attachment 14, wherein adjacent points of attachment are spaced from one another by an interloop distance d. The interloop distance (i.e., the distance between adjacent loops) may vary. The loops have a diameter sufficient to enable a person to insert a shoulder therethrough and preferably greater than six inches. The interloop distance d is between 4 and 15 inches and most preferably about 9 inches. For certain combinations of stretches, it may be desirable to provide a device wherein the interloop distance varies from loop to loop along the strap body portion.

Operation of the Invention

The device 10, shown in FIG. 1, is easy to use as shown in FIGS. 2–4. Typically, in order to perform a stretch such as the stretch illustrated in FIG. 3, a person lies on the floor and inserts each foot into a loop 11 or 12 (or similar limb engagement means affixed to a flexible strap). The choice of loop(s) for engaging the limbs will depend on the size of the person and the stretch that will be performed. In the illustrated stretch, the end loops 11 are preferred. Next, the person inserts each arm or shoulder into another loop 12 which loops are chosen for comfort. Various yoga position or stretching exercises are possible by insert the arms or shoulders into different loops. The same effect is achieved by doing the same with the feet or legs.

In summary, a method for for using the device described above for stretching a targeted muscle or group of muscles within the body of a person is disclosed. An exemplary method for using the device to stretch a hamstring muscle in a leg comprises the steps of engaging a portion of the person's left and right arms, the portion being proximal (i.e., closer to the person's body) to the person's left and right wrist such as the upper arm or shoulder, with a first and second limb engaging means (i.e., a first and second loop) on the device. Then the foot of the leg to be stretched is placed in a third loop. The person then straightens the leg and relaxes the muscles of the body. A portion of the weight of the arms and torso is supported by the strap and pulls the straightened leg toward the person's head thereby stretching the targeted hamstring muscle. The position may be effortlessly maintained until the stretch is completed.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A device having integral construction and operable for assisting a person to stretch a targeted tissue in the person's body by assuming a relaxed position comprising: (a) a flexible strap having loops formed in opposing ends thereof and a strap body portion therebetween; and (b) a plurality of independent loops formed in said strap body portion, each loop comprising said plurality of loops having a diameter of at least six inches, and wherein each loop comprising said plurality of loops is formed in said strap body portion at a point of formation, wherein said point of formation for each loop comprising said plurality of loops is spaced between four and fifteen inches from an adjacent point of formation.

* * * * *